United States Patent [19]

Da Costa et al.

[11] Patent Number: 4,968,228

[45] Date of Patent: Nov. 6, 1990

[54] HOUSING FOR HORIZONTAL ROLLING PISTON ROTARY COMPRESSOR

[75] Inventors: Caio Mario F. N. Da Costa; Juscelino F. Dos Santos, both of Joinville, Brazil

[73] Assignee: Empresa Brasileira de Compressores, Joinville, Brazil

[21] Appl. No.: 361,960

[22] Filed: Jun. 6, 1989

[30] Foreign Application Priority Data

Jun. 9, 1988 [BR] Brazil ..... PI8802895

[51] Int. Cl.[5] ..... F04B 39/12

[52] U.S. Cl. ..... 417/423.14; 417/902

[58] Field of Search ..... 417/423.14, 902, 410

[56] References Cited

U.S. PATENT DOCUMENTS 2,907,515 10/1959 Davey ..... 417/902 X 3,189,256 6/1965 Bachmann ..... 417/902 X

*Primary Examiner*—John C. Fox

*Attorney, Agent, or Firm*—Darby & Darby

[57] ABSTRACT

A housing for a horizontal rolling piston rotary compressor, of the type having a tubular shape to which is rigidly fastened on its inside surface, supporting surfaces (33,34) for a generally cylindrical cylinder/electric motor unit. The lower half (12) of the cross section of the housing (10) has an approximately semi-polygonal contour which, in regions which are not superposed on the cylindrical supporting surfaces (33,34) is expanded and separated from the cylinder (20)/electric motor (30) unit, increasing the storage capacity and oil circulation capacity of the housing, without substantially modifying the outside dimensions of the compressor.

7 Claims, 2 Drawing Sheets

HOUSING FOR HORIZONTAL ROLLING PISTON ROTARY COMPRESSOR

BACKGROUND OF THE INVENTION

This invention refers to horizontal rolling piston rotary compressor and, particularly, to a new construction of a housing for this type of compressor used in refrigerators, freezers and other refrigeration appliances. The adequate amount of oil inside a compressor is an important factor for its good operation, as the good lubrication of movable parts and the cooling of the electric motor depend on this.

Another important function of oil is its capacity to absorb the refrigerant gas from the cooling system.

Such absorption causes, at compressor stops, the lowering of equalized pressures in suction and discharge of the compressor. Thus, the larger the amounts of oil inside the compressor housing, the larger will be the amount of absorbed refrigerant fluid and, consequently, the lower the equalized pressure and easier the start of the compressor after each stop, i.e, the compressor will start with lower voltages, improving its power performance.

In horizontal rolling piston rotary compressors, the maximum oil level inside the housing is limited, on the one hand, by the outside diameter of the motor rotor, which has to rotate freely without skidding on the oil film. On the other hand, the amount of oil is limited by the inside diameter of the compressor housing.

The rolling piston rotary compressors do not need the suspension system of the cylinder/motor unit by springs, since their vibration level is low (almost perfect balancing). Due to this fact, these compressors may have the cylinder/electric motor unit rigidly fastened to the housing. Thus, the manufacturers choose substantially circular housings of round transversal section, which are easy to manufacture.

The above mentioned restrictive aspects, bring about a reduction of the quantity of oil to be used for the compressor, limiting all benefits which a larger amount of oil could offer.

It is known that horizontal rotary compressors must operate with a quantity of oil equivalent to the similar vertical models. However, due to the already described restrictions, these compressors operate with a lesser quantity of oil.

One of the possibilities which could be used to increase the oil level in horizontal compressors would be to diminish the diameter of the electric motor rotor, which, obviously, is undesirable, as it would reduce the efficiency of the motor and also cause difficulty in the standardization between the horizontal and vertical models of the same series.

Another possibility to increase the quantity of available oil would be simply to increase the length of the housing and, consequently, its inside volume, which is, obviously, a disadvantage, as it would raise the expenses for raw material and require a larger space to be occupied by the compressor when assembled in, the refrigerator.

BRIEF DESCRIPTION OF THE INVENTION

The purpose of this invention is to provide a construction of a housing for a horizontal rolling piston rotary compressor, which may contain a larger quantity of oil, which does be easy to manufacture and to assemble, which would not bring about significant additional cost of raw material, which does not increase the main external dimensions of the compressor and which does not impose any additional restriction to the electric motor rotor diameter or to the performance of the compressor operation.

In accordance with this invention, the housing of the horizontal rolling piston rotary compressor, of the type which has a tubular shape, has fastened, rigidly, in its inside surface, the cylinder/electric motor unit. The lower half of the housing cross section, has an approximately semi-polygonal contour which, in regions which do not conform to the motor supporting surfaces is external, i.e. expanded from to the respective lower half of a circular contour circumscribed to the support surfaces of the cylinder/electric motor unit of the upper half of the housing into the respective lower half of the contour of a square circumscribed having the mentioned circular contour on a part of its horizontal lower side.

A preferred embodiment of the housing has its cross section defined by a semi-circular upper half and a lower half defined by two straight side sections, inwardly inclined towards with their lower ends having convex arcs each joining with a lower straight section slightly inclined upwards starting from a convex arc, placed in the compressor center region.

The construction of the above defined housing makes it possible to obtain a significant increase of oil quantity which may be contained in the compressor housing, and, consequently, all previously mentioned advantages with relation to the increase of oil quantity, without causing any increase in the space required for the assembly of the rotary compressor in the cooling equipment.

An additional advantage of the new housing is that it makes easier the oil and gas flow inside the compressor, which flow was previously quite restricted by the electric motor stator, thus making possible a better cooling of the electric motor, which is advantageous for the power and even volumetric efficiency of the compressor.

Another characteristic of the new housing is its easy manufacture, specially when it is press formed as a body/cover system. Another characteristic is that the fastening of the cylinder/electric motor unit in the housing may be performed in the same manner conventionally adopted for rotary compressors, i.e., rigid fastening by interference on the stator outside surface and by spot welding on the compressor unit.

BRIEF DESCRIPTION OF THE DRAWINGS

The invention will be hereafter described with reference to the hereto attached drawings, where.

DETAILED DESCRIPTION OF THE INVENTION

Figure 1:
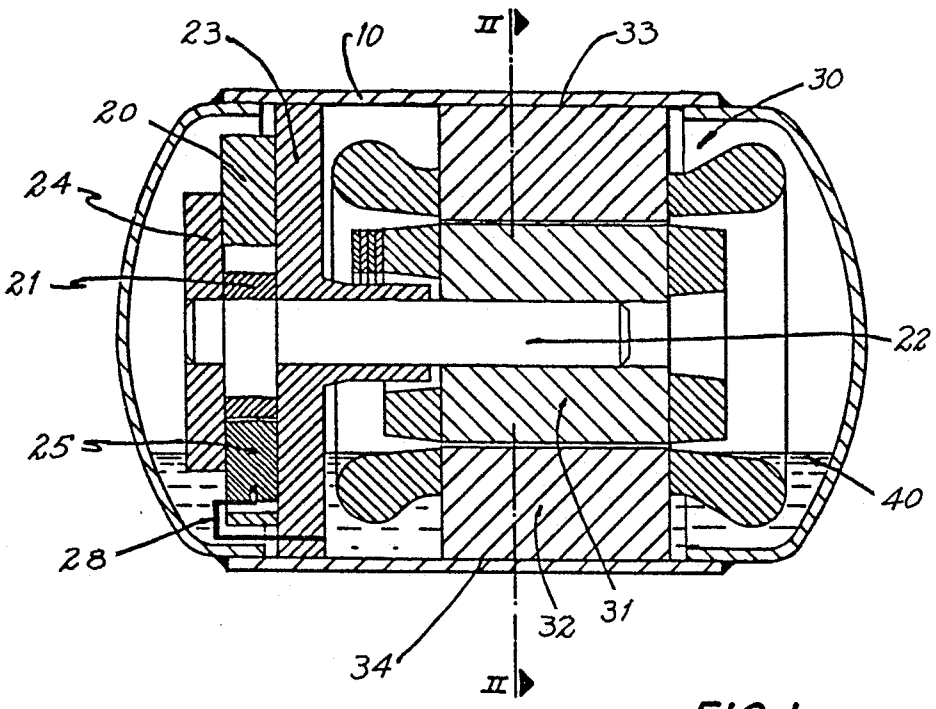
FIG. 1 is a sectional longitudinal drawing of a rolling piston rotary airtight compressor, in accordance with this invention.

According to the above-mentioned illustrations, the hermetic rotary compressor comprises a housing 10 of a substantially cylinder tubular shape and horizontally placed, which contains an assembled unit formed by a cylinder 20 which houses a rotating eccentric piston 21 driven by a shaft 22. The shaft 22 is supported by a pair of bearings 23 and 24 and driven by a rotor which forms, together with the stator 32, the electric motor 30 of the compressor.

Cylinder 20 also houses a vane 25, the upper end of which rides on the surface of the rotating piston 21 at the same time in which it reciprocates inside a groove (not shown in the drawing) driven by the piston and a spring 26. The lower part of the housing 10 serves as a reservoir for the lubricating oil 40, required for the lubrication of the compressor mechanical components.

Figure 2:
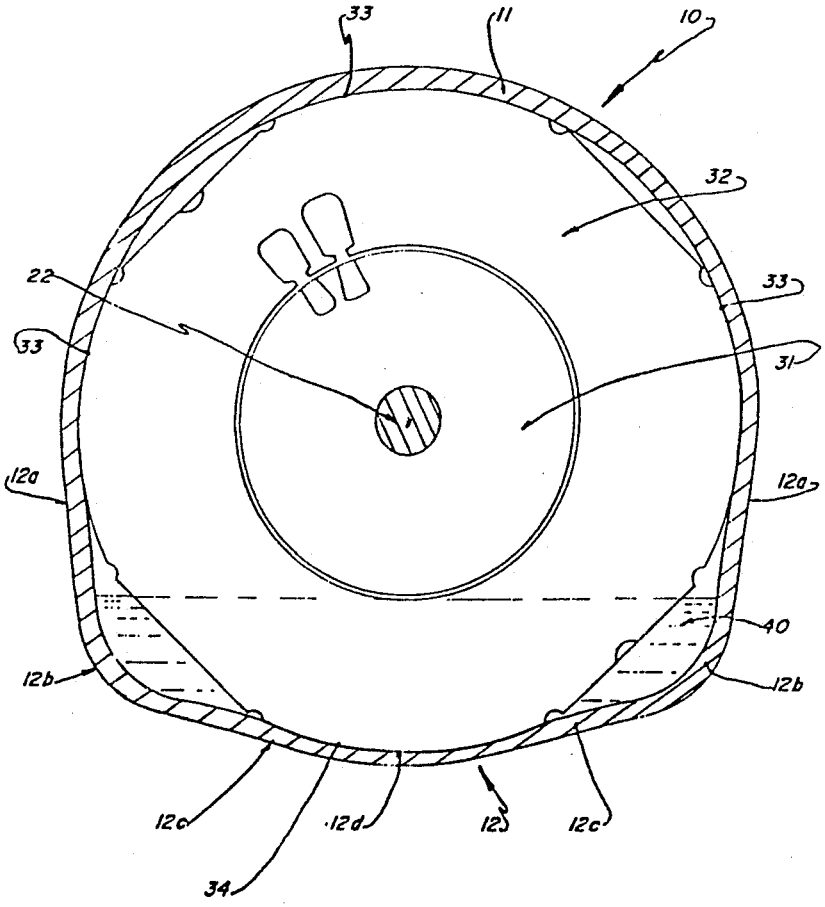
FIG. 2 is a sectional view of the compressor shown in FIG. 1, illustrating the motor and the housing of the compressor, according to the line II—II indicated in FIG. 1.

As shown in FIG. 2, the housing 10 has a cross section defined by an upper half 11, conforming to the surfaces of the upper support 33 of the cylinder/electric motor unit and coinciding with a lower half 12, is defined by two side sections **12*a*, which are straight or slightly bent and inclined inward and with each of their lower ends having a convex arc 12*b* from which extends a straight lower section 12*c* or slightly bent and inclined upwards starting from an elongated convex area 12*d***, positioned in the medium part of the compressor.

The polygonal contour chosen for the lower half 12 of the housing 10 must have a bowed section, represented by the medium lower convex arch **12*c* in the illustrated configuration, to conform to the surface of the lower support 34 of the cylinder/electric motor unit, which is seated thereon. This is done to avoid requiring any modification in the original overall generally circular shape of the support surface and permitting the maintenance of standardized cylinder/electric motor units and with support surfaces in the housing symmetrical in relation to the longitudinal axis of the compressor. The overall volume of oil stored in the lower part of the housing 10 may thus be increased without its level reaching the surface of rotor 31**.

This increase of the oil volume stored in the housing permits the absorption of a larger quantity of refrigerant by oil, resulting in formerly described advantages.

The shape of the housing such as described meets, consequently, the requirements of the invention, as its manufacture and assembly is easy, it does not call for any significant additional cost for raw material and does not increase the main outside dimensions of the compressor. The described solution permits further that an adequate amount of oil is stored in the housing without imposing additional restrictions to the electric motor rotor diameter or to the compressor performance.

Although it is here shown in one particular form of realization only, it must be understood that the housing may present other simple or composed polygonal contours, specially in its lower half, so as to increase the oil storage capacity without increasing the outside dimensions of the compressor.

We claim:

1. The combination of a housing having sealed therein a horizontal motor compressor unit of the rotating piston type whose outer surface for supporting the housing is overall generally cylindrical, the upper half of said housing having a generally circular cross-section to conform to the overall shape of the motor compressor supporting surface, the lower half of the housing being expanded outwardly from a circle to increase the housing cross-sectional area for holding more lubricant with a part of the housing lower half formed to contact the motor compressor supporting surface.

2. The combination of claim 1 wherein the housing lower half cross-section has the overall shape of a part of a square.

3. The combination of claim 1 wherein the housing lower half cross section has a straight side wall extending downwardly from each end of the upper half cross-section, a curved radius on the bottom end of each side wall and a bottom generally horizontal wall extending between the two curved radii.

4. The combination of claim 3 wherein the central part of the lower half bottom wall is curved to conform to the motor compressor outer supporting surface for contact therewith.

5. The combination of claim 4 wherein the lower half bottom wall has a part which inclines upwardly from each end of the curved central part to the curved radius lower bottom end of each side wall.

6. The combination of claim 5 wherein each said lower half side wall is bent somewhat inwardly toward the lower half bottom wall curved central part.

7. The combination of claim 4 wherein each said lower half side wall is bent somewhat inwardly.

* * * * *

UNITED STATES PATENT AND TRADEMARK OFFICE

CERTIFICATE OF CORRECTION

PATENT NO. : 4,968,228

DATED : November 6, 1990

INVENTOR(S) : Caio M.F.N. DaCosta

It is certified that error appears in the above-identified patent and that said Letters Patent is hereby corrected as shown below:

In the cover page, item [73] Assignee:

please delete "Assignee: Empresa Brasileira de Compressores" and substitute therefor --Assignee: Empresa Brasileira de Compressores S/A - EMBRACO--.

Signed and Sealed this

Twentieth Day of July, 1993

*Attest:*

Michael K. Kirk

MICHAEL K. KIRK

*Attesting Officer*

*Acting Commissioner of Patents and Trademarks*